United States Patent [19]

Martin et al.

[11] Patent Number: 4,875,277

[45] Date of Patent: Oct. 24, 1989

[54] FORMED METAL CORE BLOCKING METHOD

[75] Inventors: Richard W. Martin, Versailles; John L. Fisher, Lexington; William R. Fortenberry, Versailles; Randall L. Schlake, Lexington; Ronald F. Dornbrock; James D. Richerson, both of Versailles; Kenneth E. Marrett, Sr., Lebanon, all of Ky.

[73] Assignee: Kuhlman Corporation, Troy, Mich.

[21] Appl. No.: 256,883

[22] Filed: Oct. 12, 1988

Related U.S. Application Data

[62] Division of Ser. No. 906,855, Sep. 12, 1986, Pat. No. 4,833,436.

[51] Int. Cl.[4] ..... H01F 7/06

[52] U.S. Cl. ..... 29/606; 29/602.1; 29/463

[58] Field of Search ..... 29/602.1, 606, 463; 336/60, 92, 185, 229

[56] References Cited

U.S. PATENT DOCUMENTS

| | | | |
|---|---|---|---|
| 1,231,516 | 6/1917 | Fondiller . | |
| 2,290,680 | 7/1942 | Franz . | |
| 2,431,867 | 12/1947 | Galla . | |
| 2,769,962 | 11/1956 | Melville . | |
| 3,068,381 | 12/1962 | Vazquez . | |
| 3,179,908 | 4/1965 | Peabody . | |
| 3,201,734 | 8/1965 | Halacsy . | |
| 3,340,489 | 9/1967 | Bastis et al. . | |
| 3,504,319 | 3/1970 | Leonard . | |
| 4,297,665 | 10/1981 | Paton et al. | 336/60 |

FOREIGN PATENT DOCUMENTS

| | | |
|---|---|---|
| 0083567 | 7/1983 | European Pat. Off. . |
| 1105294 | 3/1968 | United Kingdom . |

*Primary Examiner*—P. W. Echols

*Attorney, Agent, or Firm*—Townsend and Townsend

[57] ABSTRACT

The invention is directed to a formed metal blocking, for mounting within wedge-shaped gaps between coils of a toroidal transformer, including butterfly-shaped top and bottom core blockings. The blockings are formed from identical stampings, each stamping having a pair of U-shaped coil-engaging faces joined along their inner legs by a center web. The stampings are joined back to back and have a number of flanges which are bent over for securing the stampings to one another. The stampings have an apertured tab at the end of the center web used to form a lifting eye for the top blocking. With the bottom blocking, the tabs are folded over for mounting to a base plate. The outer legs of the U-shaped faces are longer than the inner legs and center web to create a gap in the electric path surrounding the core.

21 Claims, 6 Drawing Sheets

FORMED METAL CORE BLOCKING METHOD

This is a division of application Ser. No. 906,855 filed 9/12/86, now U.S. Pat. No. 4,833,436.

BACKGROUND OF THE INVENTION

In the toroidal transformer design disclosed in U.S. Pat. No. 4,779,812, dated Oct. 25, 1988, which is a continuation of application Ser. No. 06/705,045 filed June 27, 1985, now abandoned, entitled "Toroidal Electrical Transformer and Method of Producing Same," this application being a continuation of 06/337,356, filed Jan. 6, 1982, now abandoned and in a copending Application Ser. No. 06/662,312, filed Oct. 17. 1984, entitled "Apparatus And Method For Fabricating A Low Voltage Winding For A Toroidal Transformer," now U.S. Pat. No. 4,665,952 a core wound of a single continuous strip of magnetic material is surrounded by two arcuate coil assemblies, each having a high voltage winding and a low voltage winding, and each being of a substantially continuous conductor. Each arcuate coil assembly extends over approximately 165° of the toroidal core leaving a space between the two coil assemblies of approximately 30° (32° in one preferred embodiment). Two like-size, wedge-shaped spacers are mounted in these spaces to separate the two coil assemblies. Accordingly, each space is approximately 15° (16° in one preferred embodiment).

In the final assembly of the toroidal transformer, it is necessary to support the coil assemblies with respect to the core and transformer tank so as to prevent movement and consequent damage to the coil assemblies during transportation and operation of the toroidal transformer. In the above-referenced application, this was accomplished by a pair of butterfly-shaped core blocks which were inserted between the coil assemblies, one from the bottom and the other from the top of the toroidal transformer assembly. The butterfly-shaped core blocks had wings of approximately 15° (16° in one preferred embodiment) to correlate with, and fill the space between the two coil assemblies. The two butterfly-shaped blocks had a rectangular cut-out in each wing which accommodated the core and which were contiguous at the centerline of the toroidal transformer.

In the above-referenced applications, the teachings of which are incorporated herein by reference thereto, the butterfly-shaped core blocks were fabricated from a moldable-polyester resin. The moldable-polyester resin had the advantage of being a dielectric, so as to not present the risk of a short circuit of the transformer windings, and also had the characteristic of being nonmagnetic, so as to obviate any interference with either the performance characteristics of the transformer or its operation through interaction with the magnetic flux generated within the transformer as a result of the energization of the electrical windings of the transformer.

Each of butterfly-shaped core blocks of the above-referenced applications, while having the above advantages and being suitable from a functional standpoint, was relatively expensive because polyester resins suitable for use in transformers are relatively expensive. In addition, the strength of the structure was limited by the available space for the core block which in turn limited the size of the core block. Given the inherent structural integrity of the moldable-polyester resin, its strength was limited due to the rather confined space between the two coil assemblies. Additionally, the butterfly-shaped core block of the above-referenced application had a disadvantage in that oil or coolant flow passages could not be provided without adding substantially to the complexity of the mold necessary to form such coolant passages and without compromising the strength of the core block as a result of the voids provided by the coolant passages.

SUMMARY OF THE INVENTION

The present invention provides an improved core block by using a material which would, in and of itself, suggest its unsuitability for this purpose, namely, steel. Alternatively, however, another metal could be used, but steel is clearly preferred because of its high strength and relatively low cost. Of course, steel is both ferromagnetic and electrically conductive, thus presenting the concern of possible adverse electrical or electromagnetic interactions with the transformer, for example, either short circuits or a low reluctance magnetic flux path which can interfere with, and possibly damage, the transformer. Steel, as well as a number of other metal candidates for the present invention, offers the advantage of substantially lower cost construction than the moldable-polyester resin used in the core block of the above-referenced application. A steel core block, to be a successful alternative to the moldable-polyester resin core block, must be fabricated in a way that the cost advantages of steel are obtained, significant adverse electrical and electromagnetic interactions are avoided, structural integrity is provided which would accommodate even the most severe expected use conditions to which a transformer is subjected (including transients created by overvoltage and short circuit conditions), and must be capable of being readily fabricated and installed into the toroidal transformer during its assembly.

These objects have been obtained with the invention as described herein, and the lower cost advantages of steel, or other substitutable metal material, have been obtained. Additionally, provision has been made for oil or other coolant flow passages consistently with the attainment of all of the above objects.

Basically, these objects have been achieved by providing a steel (or other suitable metal) stamping of a singular configuration which can be used to fabricate two butterfly-shaped core blocks. In other words, a single steel stamping provides each half of a bottom core block and each half of a top core block for a total of four stampings per transformer assembly.

Each of these steel stampings comprises a pair of U-shaped coil-engaging face members which are joined to a central web and which form a dihedral with respect to the central axis of the web. The coil-engaging face members are U-shaped to provide a pocket for receiving the core (and a bobbin, if used). The dihedral angle provides two approximately 15° (16° in one preferred embodiment) wedges to accommodate primary and secondary winding assemblies which occupy approximately 330° of the core. Of course, the angle of each of the wedges could be varied to accommodate primary and secondary winding assemblies which encompass more or less of the core. The preferred range would extend substantially between 5° and 30°, but other angles could be used while still retaining one or more of the principles and advantages of this invention.

Each coil-engaging face member includes a wedge-shaped core support flange at the bight of the U, an inside flange at the radially-inside leg of the U, and an outside flange at the radially-outside leg of the U. The core support flange supports the core (and bobbin, if used) at one of its planar top or bottom surfaces and the inside flange supports the core (and bobbin, if used) at its hub. The U-shaped opening also includes a core locating shoulder, preferably rounded, for locating the radially-outside surface of the core (and bobbin, if used). The outside flange is principally used to strengthen the stamping and provide a smooth edge to prevent damage to transformer leads, e.g. the low voltage leads. Each coil-engaging face member also has an anchor flange at the outside thereof which is adapted to be secured to an anchor strap or other attachment structure for secure attachment to the tank which contains the transformer to thereby prevent movement within the tank.

Each coil-engaging face member is also provided with a pair of wedge-shaped end flanges. With respect to the bottom support block, the end flanges are used to mate and join with a pilot locator base plate and thereby guide the transformer to a fixed position in the center of the tank upon installation and assist with the retention of the transformer in such fixed position during shipment and use. Additionally, the two identical stampings, from which the top core block is formed, are each provided with a lifting eye flange which extends upwardly and has a central opening for receiving a lifting hook. The lifting hook facilitates lifting of the transformer, including mounting and removal of the transformer. In the case of the two identical stamping members which constitute the lower core block, the lifting eye flanges are folded outwardly to advantageously provide an additional horizontal flange which mates with the pilot locator base plate. In this manner identical stampings are used for both the top and bottom core blocks and identically stamped eye flanges are usable for two entirely different functions.

A plurality of appropriately-located extruded or formed ribs are arrayed across the coil-engaging face members to increase the strength and rigidity of those members. Optionally, passages can be provided for flow of coolant, such as liquid or gas coolants, and may be in the form of through-holes or slots through the coil-engaging face members or recesses and notches in the peripheral portions of the steel stamping.

In the joining of the steel stampings to fabricate the upper and lower blocks, two steel stampings are mated with the central webs adjacent one another. The wedge-shaped core support flanges and the wedge-shaped end flanges of one stamping are bent towards the corresponding flanges of the other stamping so that the opposed flanges overlap each other. For this purpose, such flanges are located so that opposing flanges are displaced by one thickness of the stamped material so as to overlap and mate. The end flanges also overlap and mate, and thus the opposing flanges are displaced by one material thickness to facilitate such overlapping and mating. When the two steel stampings are mated with the flanges in the opposing and overlapping relationship, the central webs are also mated typically by lying in side-by-side engagement with one another.

After such mating of the two steel stampings a series of welds are made, preferably, two on each wedge-shaped coil supporting flange and three on each wedge-shaped end flange. To provide a flush surface puddle welds may be used on these flanges. Additionally, three welds are made on the anchor flange, with two such welds preferably along the flange edge of the outwardly-displaced flange and one along the flange edge of the inwardly-displaced flange. Finally, a number of spot welds, for example, six, are made to join the two center webs securely.

As previously indicated, in the case of the top blocking member, the lifting eye flange or tab is allowed to extend upwardly to provide a suitable loop or lifting eye for receiving a hook for insertion and removal of the transformer from its tank. In the case of the bottom block, the tab is folded outwardly and a pilot locator base plate is welded to both the wedge-shaped end flanges and the outwardly-folded tabs. For example, a clamp-type weld device can be used to weld the pilot locator base plate at its lateral extremities to the wedge-shaped end flange and a series of spot welds, e.g. four, join the pilot locator base plate to the outwardly-folded eye flange.

Once the top and bottom butterfly-shaped blocks are fabricated, each is provided with an insulating layer, preferably by use of suitably-cut kraft paperboard as is well known in the transformer industry. Alternatively, the blocks could be insulated by a suitable insulation coating applied to the blocks, e.g., by spraying or immersion, after assembly.

In one preferred form of the use of electrical kraft paperboard, four panels of paperboard, one for each side of the two core blocks, are made up and formed so as to generally conform with the center web and the two coil-engaging, U-shaped face members of the block. Consequently, a panel having two "E"-shaped portions joined back-to-back is formed. The legs of one "E" portion are longer than the legs of the other "E" portion. The panels are thereafter folded to form a pair of overlapping "E" flaps, thereby doubling the thickness of the insulation. Additionally, since the legs of one "E" are longer than the legs of the other "E", the longer legs extend outwardly from the shorter legs. Consequently, the insulation paperboards, when installed in a transformer, will mate with the respective outwardly-extending legs of the panels on the opposing blocks lying in an overlapping fashion. When mated, the shortfall of the set of legs of one panel correlates with the longer legs of the opposing paperboard insulation panel to provide two layers of paperboard throughout and a lengthened creepage path due to the offset between the two paper insulation members. Preferably, the legs, both long and short, of the paperboard panels mated with the lower block extend upwardly of the lower block to facilitate assembly since it is more difficult to insert the legs of the upper paperboard panels downwardly into the spaces between the lower block and the coils than to arrange the legs of the upper paperboard panels with the upwardly-extending legs of the lower paperboard panel prior to insertion of the upper block. Holes or slots may be formed in the insulation panels to match any coolant openings in the stampings.

DETAILED DESCRIPTION OF THE PREFERRED EMBODIMENT

Figure 1:
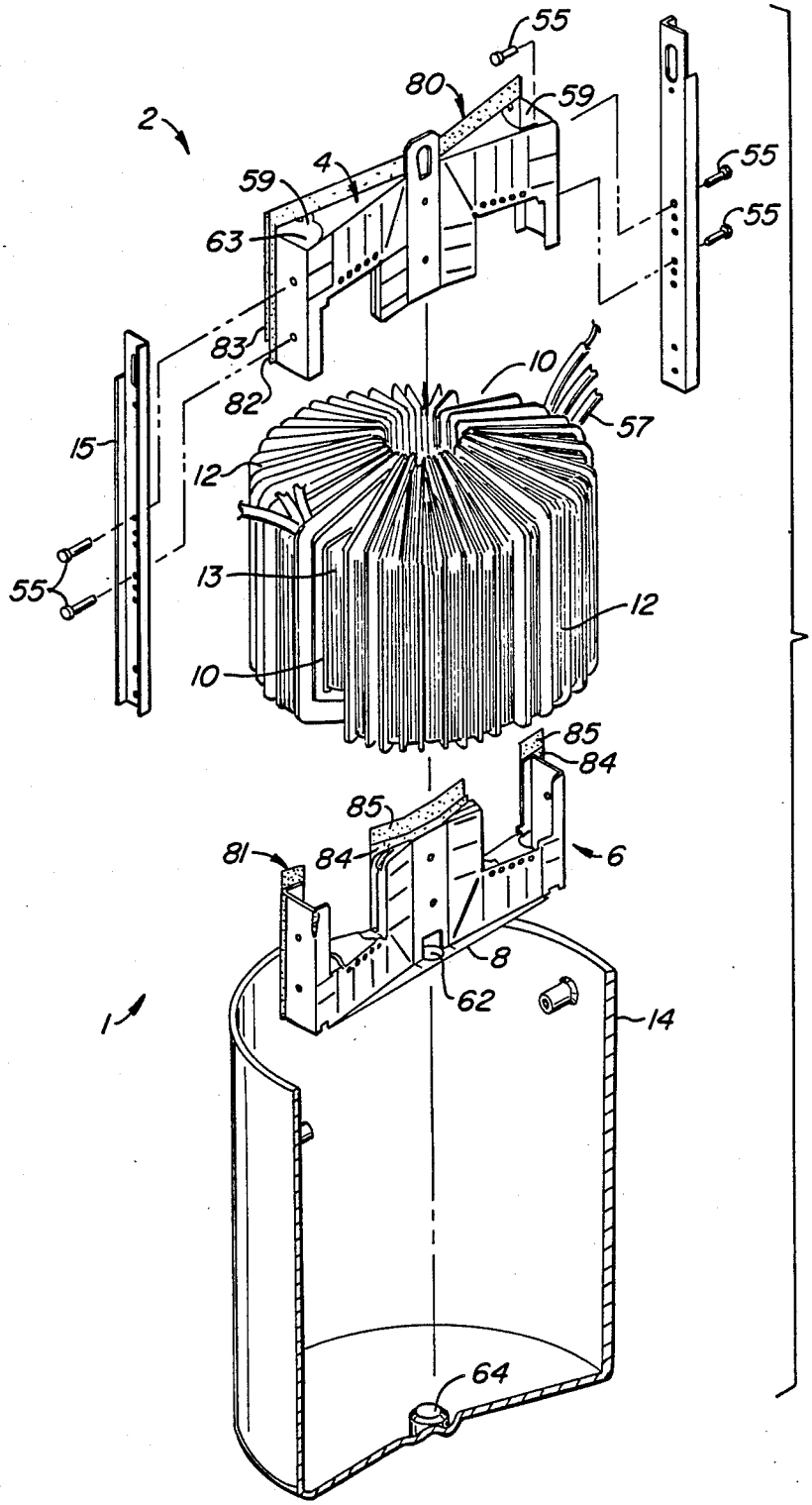
FIG. 1 is an exploded perspective view of a toroidal transformer including a stamped metal core blocking made according to the invention.

Referring now to FIG. 1, transformer 1 is seen to include a core blocking 2, including a top blocking 4, bottom blocking 6 and a base plate 8. Core blocking 2 is mounted within the wedge-shaped gaps 10 defined between the two coil assemblies 12, and around core 13. Blocking 2 also includes transformer straps 15 which secure top and bottom blockings 4, 6 to one another. Blocking 2 both separates coil assemblies 12 and positions the coil assemblies within a transformer tank 14.

Figure 2:
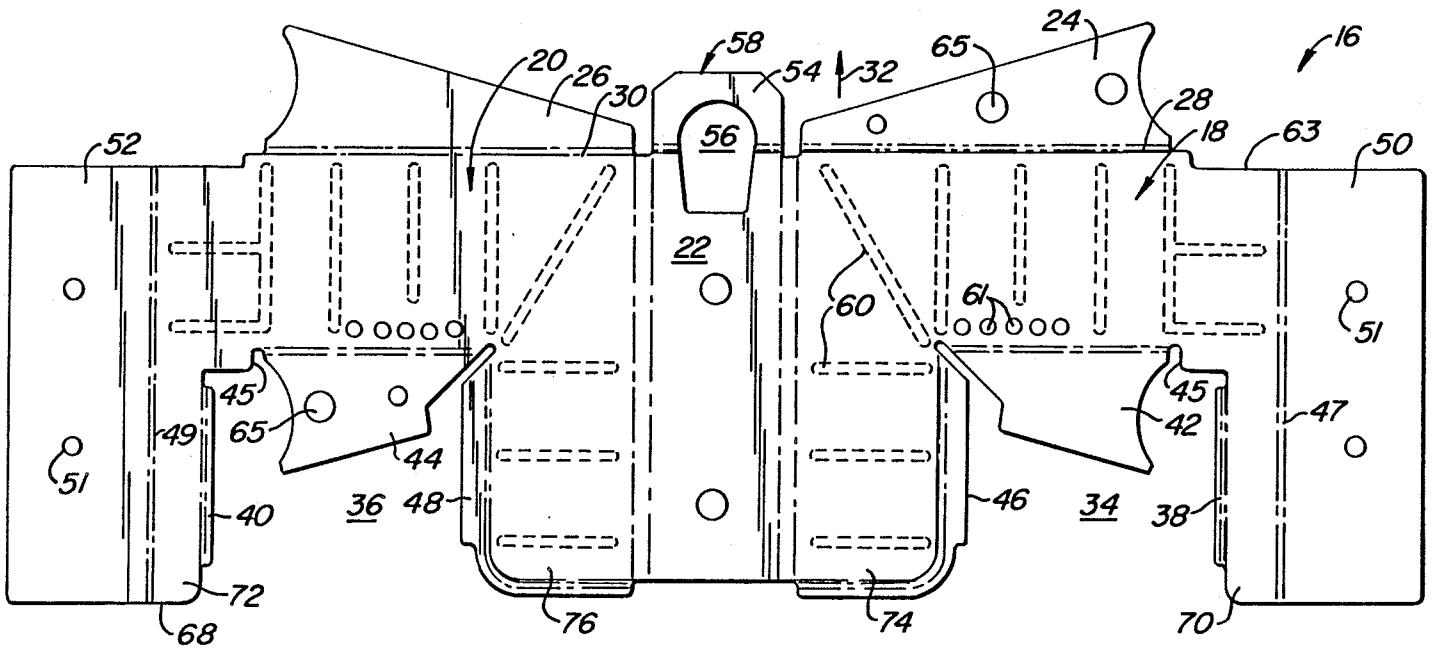
FIG. 2 is a plan view illustrating one of the four identical stampings, used to form the top and bottom core blockings of FIG. 1, shown in its flat configuration prior to forming. The edges of the fold areas are indicated by center lines and the creased areas are shown by dashed lines.
Figure 3:
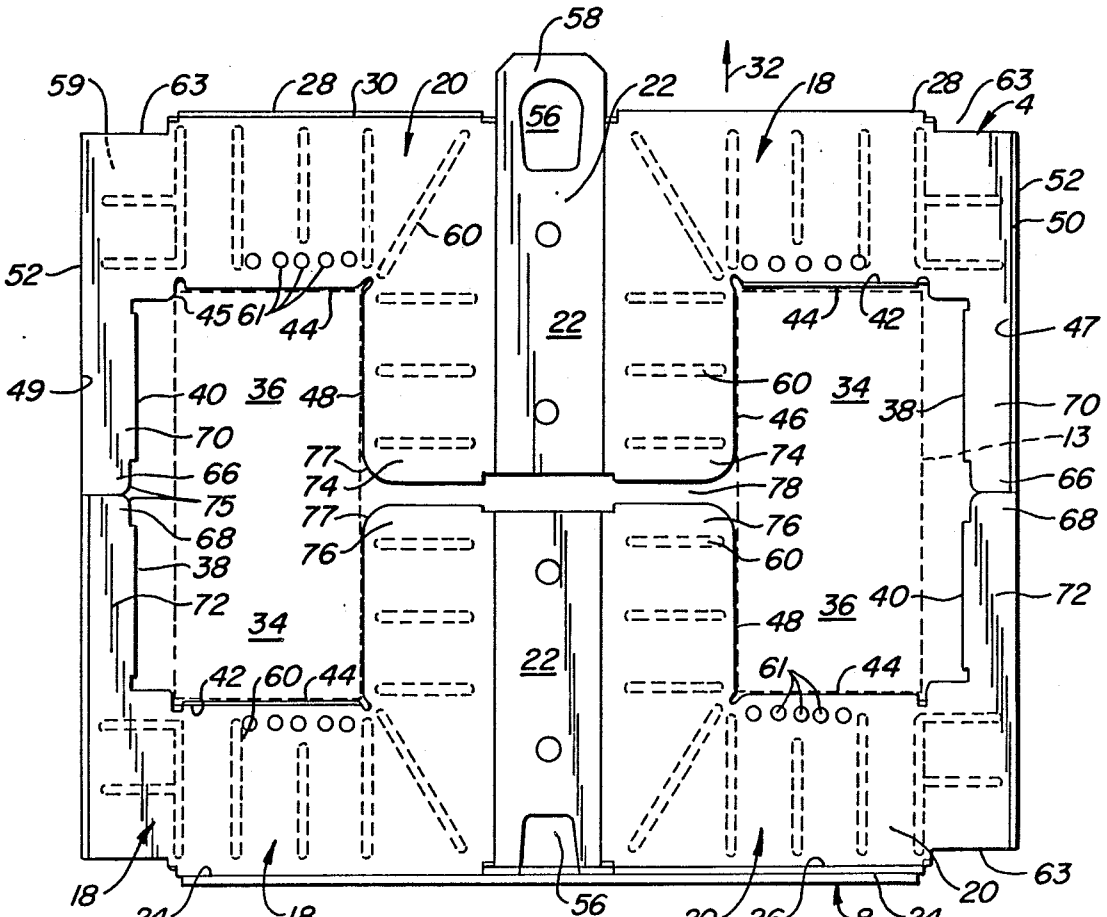
FIG. 3 is a side view of the top and bottom core blocking of FIG. 1 positioned adjacent one another.
Figure 4:
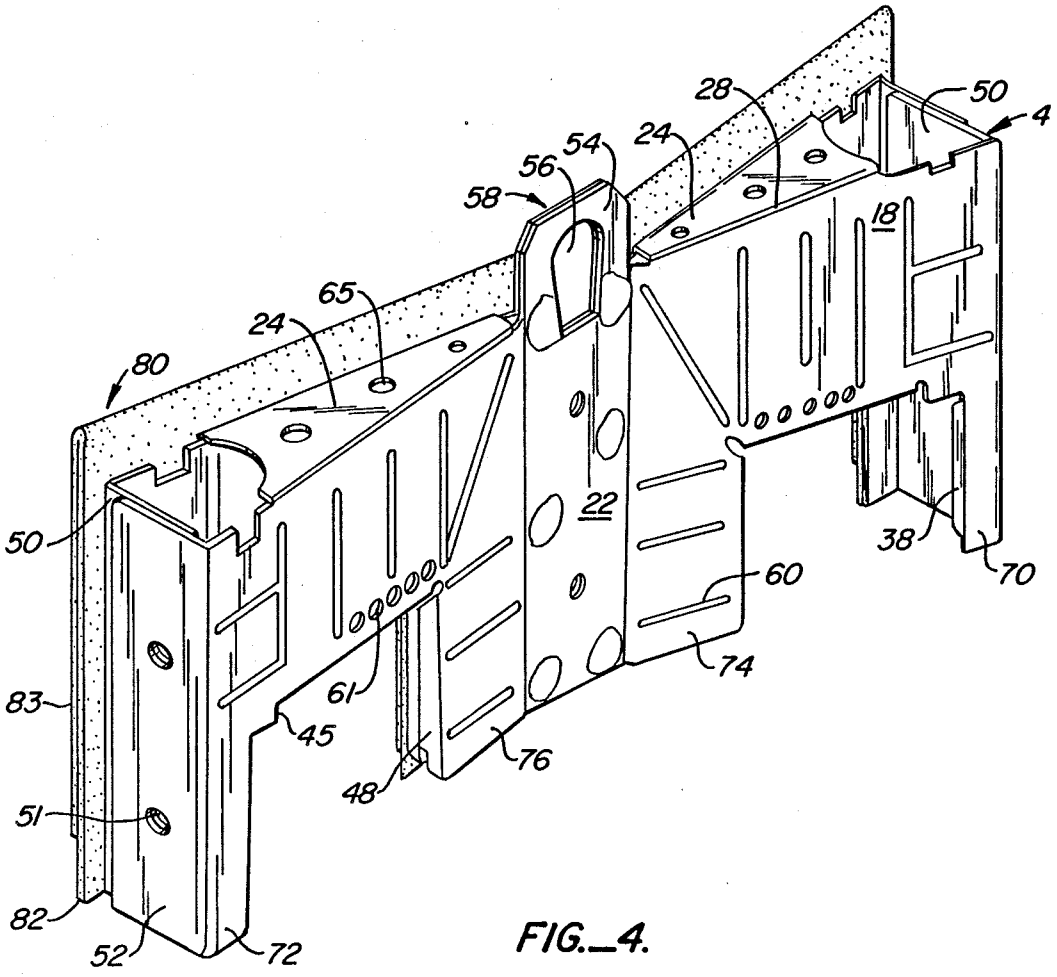
FIGS. 4 and 5 are enlarged perspective views of the top and bottom blocking of FIG. 1.

Both top and bottom blockings 4, 6 are constructed from pairs of identical metal stampings 16, shown in FIG. 2. Stamping 16, as shown in FIG. 2 is in its flat, cutout condition before being folded. Referring now also to FIGS. 3 and 4, top blocking 4 will be described. Blocking 4 includes a pair of U-shaped coil engaging faces 18, 20 coupled by a center web 22. Faces 18, 20 act as dihedral surfaces to form dihedral angles about 15°. Wedge-shaped end flanges 24, 26 extend from the upper edges 28, 30 of faces 18, 20. Edge 28 is offset by a distance equal to the thickness of the material from which blockings 4, 6 are made. That is, edge 28 is offset from edge 30 in the direction of arrow 32. Thus when two stampings 16 are mounted back to back with wedge-shaped end flanges 24, 26 extending towards one another, flanges 24 overlie flanges 26.

Faces 18, 20 each define a pocket 34, 36 surrounded by outside flanges 38, 40, wedge-shaped core support flanges 42, 44 and inside flanges 46, 48. A core locating shoulder 45 is provided adjacent to flanges 42, 44 for locating core 13, as shown by dashed lines in FIG. 3, within pockets 34, 36. Outside and inside flanges 38, 40 and 46, 48 do not overlap but rather are used for strength and to protect coil assemblies 12 from damage from sharp edges. Flange 44 is offset from and thus overlaps flange 42 when stampings 16 are assembled to form top blocking 4.

Stamping 16 also includes anchor flanges 50, 52 along outer edges 47, 49 of faces 18, 20, respectively. Flange 52 is outwardly offset relative to flange 50 so that when assembled flange 52 overlies flange 50. Flanges 50, 52 have aligned anchor strap attachment holes 51 to which anchor straps 15 are secured by rivets 55 or other fasteners. Rivets 55 have smooth internal heads so to keep from harming leads 57 passing through the channels 59 defined within top blocking 4 adjacent edges 47, 49.

Figure 5:
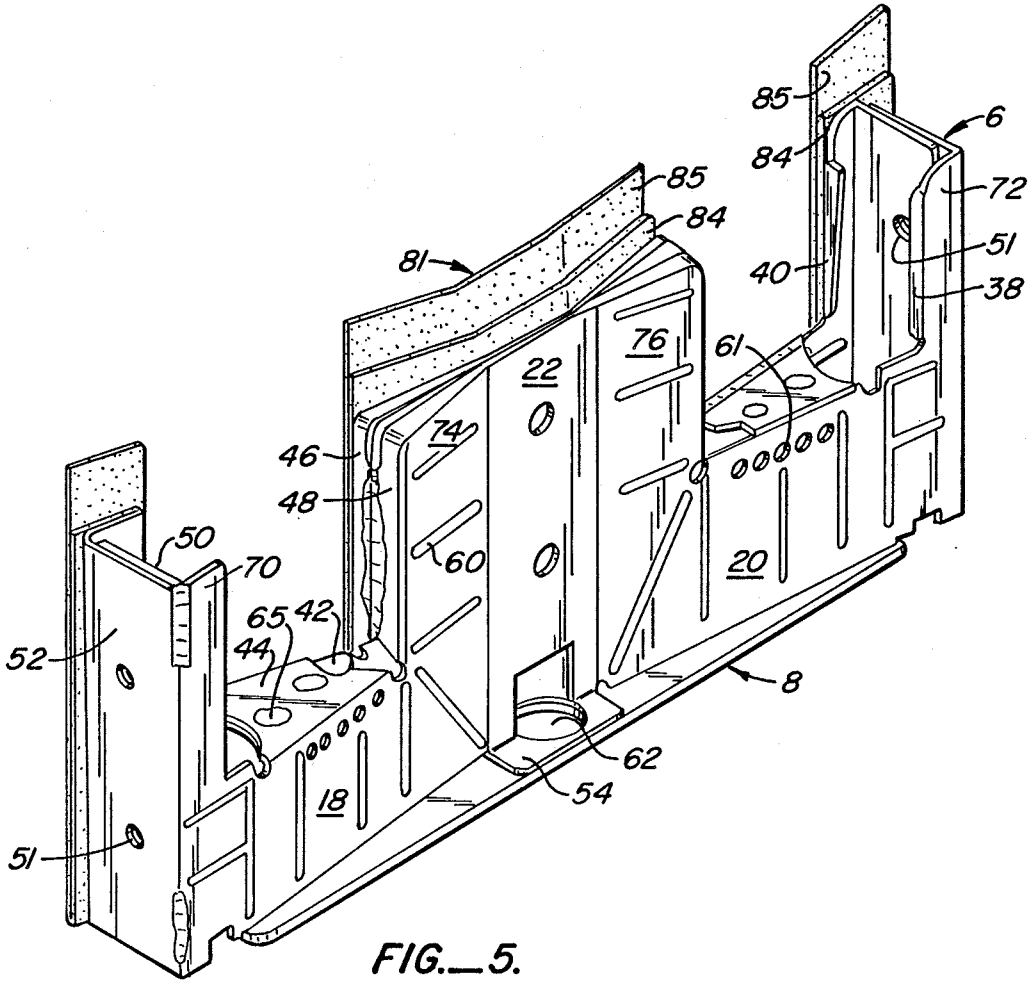

Center web 22 includes a tab 54 having a cutout 56 extending above and below edges 28, 30. When stampings 16 are used as top blocking 4, tabs 54, with their cutouts 56 act as a lifting eye 58. When stampings 16 are used as bottom blocking 6, see FIG. 5, tabs 54 are folded outwardly so that they extend away from one another to form an additional flange surface for connection to base plate 8. Thus, the only difference between top and bottom blockings 4, 6 is that with bottom blocking 6, tabs 54 are bent while they remain unbent with top blocking 4.

Figure 6:
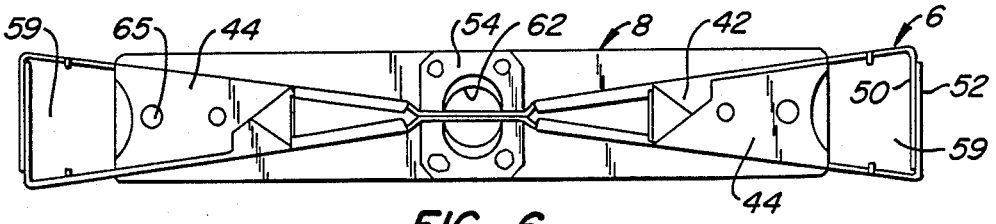
FIG. 6 is a top view of the bottom blocking of FIG. 1 with the insulator layers removed.
Figure 7:
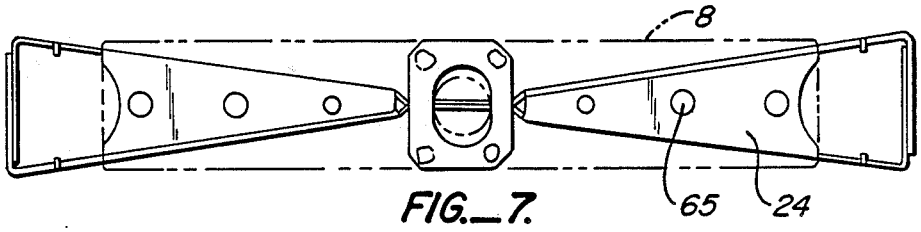
FIG. 7 is a bottom view of the bottom blocking of FIG. 1 with the insulator layers removed and the base plate shown in phantom lines.

Flaps 24, 26, 42, 44, 50, 52 and center webs 22 are secured to one another, and base plate 8 to flanges 24, 26 and to the bent-over portions of tabs 54, by welding. See FIGS. 3, 6 and 7. In particular, it is preferred to weld the two stampings to fabricate blockings 4 and 6. The presently-preferred positions of such welds, which can be varied by the designer, include two puddle welds at the openings 65 in flange 44, three puddle welds at the openings 65 in flange 24, three edge welds at the anchor flanges 50 and 52, two edge welds on flanges 46 and 48 and six spot welds on the center web 22, and four spot welds between the base plate 8 and bent tabs 54. If desired other methods of securement can be used.

Base plate 8 helps strengthen bottom blocking 6. Base plate 8 includes a central bore 62 aligned with the cutouts 56 in folded tabs 54. Bore 62 acts as a guide for receipt of a tapered positioning member 64 in transformer tank 14 to assure that core blocking 2 and coil assemblies 12 therewith are properly positioned within transformer tank 14.

During use, core blocking 2 can be subjected to very high crushing forces, for example, under short circuit conditions. For additional strength to resist such crushing without overly increasing the weight of core blocking 2 stampings 16 have creases 60 formed therein for strength, stability and rigidity. Further, stampings 16 have openings 61 formed adjacent to flanges 42, 44 and offset openings 63 (see FIG. 3) adjacent to flanges 24, 26 to provide for circulation of a coolant within blockings 4, 6.

Legs 70, 72, 74 and 76 have rounded corners 75, 77 to aid assembly of top and bottom blockings 4, 6 with core 13. When assembled with coil assemblies 12 and core 13, top and bottom blockings 4, 6 are positioned with their outer ends 66, 68 of their outer legs 70, 72 abutting. See FIG. 3. Outer legs 70, 72 are longer than inner legs 74, 76 to create a break or gap 78 between the inner legs to avoid the creation of a shorted turn around core 13. Gap 78 eliminates a shorted turn to avoid interference with the performance of the transformer which otherwise would occur as a result of the use of an electrically-conductive material, such as steel. Cores of greater width can be accommodated without changing the dimensions of the blockings 4, 6 by moving blockings 4, 6 apart.

Electrical insulation is achieved by the use of E-shaped folded insulator members 80, 81 (see FIGS. 1, 4, 5 and 8) bonded to both sides of blockings 4, 6 to cover faces 18, 20 and web 22. Insulator members 80, 81 (shown mounted to only one side of blockings 4, 6 in FIGS. 1, 4 and 5) have legs 82, 83 and 84, 85 of different lengths so legs 82 and 85 overlap when installed. This overlapping of the insulation provides superior insulation (no gaps, increased creepage path and double layer insulation) than would be available if both pairs of the legs were of the same length. The folded insulation panel 81 for the lower block 6 has short legs 84 which extend to at least the top of legs 70 and 72 and long legs 85 which extend substantially above the top of legs 70 and 72. The folded insulation panel 80 for the top block 4 has short legs 83 which are dimensioned to meet long legs 85 of the bottom insulation panel 81, and long legs 82 which are dimensioned to meet short legs 84 of the bottom insulation panel 81. Thus, the long legs 82 and 85 overlap when installed to provide a lengthened electrical creepage path. By extending the legs of 84 and 85 of the bottom insulation panel 81 upwardly to be at least as high as the lower block, assembly is facilitated since there is no need to insert the insulation legs into gaps between the lower block 6 and the coil assemblies, but rather, the upper insulation panel 80 is merely appropriately positioned before the top block 4 is inserted. Essentially it is preferred to have upper and lower legs 82, 83, 84 and 85 mate with the overlap as described with the mating occurring at least at or above the lower block 6 to facilitate assembly. For larger core heights using the same core blocks 4 and 6 a longer insulation panel 80 is used to provide the overlapping mating relationships of the legs 82, 83, 84 and 85 as described.

Preferably, the folded edge of the bottom insulation panel 81 resides on bottom plate 8 of the block while the folded edge of the top insulation panel 80 extends beyond the top of the block 4 to provide increased creepage protection of the core block 4 and protection from lead abrasion.

Figure 8:
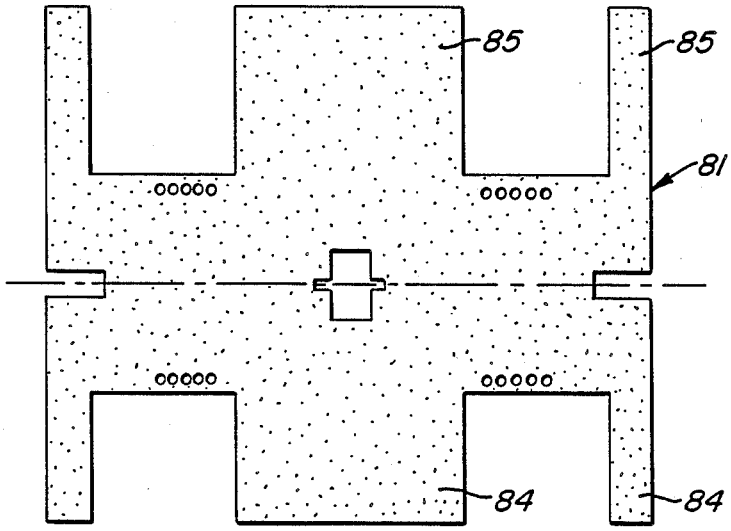
FIG. 8 is a plan view of an insulator prior to folding.

FIG. 8 illustrates the unfolded insulation panel 8 for the bottom block 6. The insulation panel 80 for the upper block 4 would be similar, but with correspondingly shorter legs to provide the mating relationship described above.

Insulator members 80, 81 may have holes aligned with any openings 61 in the blockings 4, 6 to permit free flow of coolant through the blocking 4, 6. Coolant flow is facilitated by the open spaces 63 at the bottom of block 6 the open area within blockings 4, 6, the space between the core 13 and its blockings 4, 6, and the optional openings 61.

The present invention includes the discovery that a core clamp made of a magnetic material, such as steel, can in fact extend into a core window without substantial interference with the electrical and electromagnetic operation of the transformer. This is possible by providing the substantial spacing or gap 78 at the inner legs 74, 76 and central web 22 of blockings 4, 6 to create an electrical open circuit and halt the flow of induced electrical currents through legs 74, 76 and webs 22. Also, the core 13 must be magnetically and electrically insulated from the steel blocks 4, 6, as described, to prevent significant magnetic leakage flux or circulating currents from flowing through the core blocks 4, 6. In the present embodiment these functions are achieved by the radial flange of the core bobbin. If no bobbin is used, the same result may be obtained by the use of a similarly positioned insulation, and preferably, by the use of bent flaps integral with the insulation panels 80, 81. For example, this can be achieved by folding the panel at the bight of each of the U-shaped cut-outs, rather than removing that portion of the panel.

Use of anchor straps 15 provides mechanical stability while not sacrificing electromagnetic efficiency to any significant degree because of the provision of the gap. If desired, the break in the electromagnetic path could be positioned elsewhere other than, or in addition to, inner legs 74, 76 and center web 22.

While this invention has been described in terms of a steel stamping, other forming methods may be used while still employing the features of this invention and achieving its advantages, for example, forging, extrusion, casting, etc.

Other modifications and variations can be made to the disclosed embodiment without departing from the subject of the invention as defined in the following claims. For example, but without limitations other arrangements of strengthening creases 60 could be used in lieu of or in addition to that shown.

We claim:

1. A method for manufacturing a toroidal transformer core blocking, for use with a toroidal transformer of the type having at least two coil assemblies surrounding a toroidal core and providing therebetween a pair of wedge-shaped spaces, comprising the following steps:

creating first and second identically formed steel members, each of said members having a pair of U-shaped coil-engaging faces with inner legs, outer legs and bights, the inner legs joined by a center web; and joining the members to form a butterfly-shaped core blocking with first and second wedge-shaped structures sized to fit within the wedge-shaped spaces of the transformer.

2. The method of claim 1 wherein two of said butterfly-shaped core blockings are formed for mating with the transformer coil assemblies at the top and bottom thereof.

3. The method of claim 2 wherein said members are each a stamping comprising a wedgeshaped outer flange along an outer edge of the bight for bending during the joining step to form an end surface.

4. The method of claim 3 further comprising the step of mounting a base plate to the outer flanges so to strengthen the butterfly-shaped blocking.

5. The method of claim 4 further comprising the step of welding the base plate to the outer flanges.

6. The core blocking method of claim 2 wherein each said member has anchor flanges extending from the outer legs for bending during the creating step.

7. The method of claim 6 wherein the anchor flanges overlap one another.

8. The method of claim 7 wherein the joining step includes the step of spot welding the overlapping anchor flanges.

9. The method of claim 1 wherein each of the members comprise a wedge-shaped steel stamping including core support flange at the bight for bending during the joining step.

10. The method of claim 9 wherein the core support flange of a first said stamping overlies the core support flange of a second said stamping.

11. The method of claim 10 wherein the creating step includes forming holes in at least one of the core support flanges and wherein the joining step includes puddle welding the core support flanges at the holes formed therein.

12. The method of claim 1 further comprising the step of forming coolant openings for the circulation of coolant within the core blocking.

13. The core blocking method of claim 12 wherein the coolant openings include coolant holes formed in the member and coolant recesses formed along edges of the members.

14. The core blocking method of claim 12 wherein each of the members has an apertured tab formed during the creating step, the tab extending from an edge of the center web.

15. The method of claim 14 wherein the apertured tabs of the first and second members are aligned during the joining step to form a lifting eye.

16. The method of claim 14 wherein said apertured tab is folded generally perpendicular to the center web during the joining step to provide a supplemental base flange.

17. The method of claim 16 wherein the opening in the apertured tab extends into the center web, the opening sized for receipt of an external positioning member.

18. The method of claim 1 wherein the inner legs have distal ends and the creating step includes rounding the distal ends of the inner legs.

19. A method for blocking a toroidal transformer of the type having at least two coil assemblies surrounding a toroidal core and providing therebetween a pair of wedge-shaped spaces, comprising the following steps:

creating first and second identically formed steel members, each of said members having a pair of U-shaped coil-engaging faces with inner legs, outer legs and bights, the inner legs joined by a center web;

joining the members to form a butterfly-shaped core blocking with first and second wedge-shaped structures sized to fit within the wedge-shaped spaces of the transformer;

positioning a top core blocking and bottom core blocking on either side of the transformer with the outer ends of the outer legs opposed; and thereafter securing the top and bottom core blockings to one another.

20. The core blocking method of claim 19 further comprising the step of providing an electric path interruption gap between the top and bottom core blockings.

21. The core blocking method of claim 19 wherein the outer legs of the top and bottom core blockings touch while the inner legs and center web of the top and bottom core blocking are spaced apart by an electric path interruption gap.

* * * * *